US007904971B2

(12) United States Patent
Doria et al.

(10) Patent No.: US 7,904,971 B2
(45) Date of Patent: Mar. 15, 2011

(54) PROTECTIVE PADDING AND PROTECTIVE PADDING SYSTEMS

(75) Inventors: Mason T. Doria, Cranberry Township, PA (US); Christopher A. Huber, Cranberry Township, PA (US)

(73) Assignee: Mine Safety Appliances Company, Cranberry Township, PA (US)

( * ) Notice: Subject to any disclaimer, the term of this patent is extended or adjusted under 35 U.S.C. 154(b) by 1134 days.

(21) Appl. No.: 11/133,090

(22) Filed: May 19, 2005

(65) Prior Publication Data

US 2006/0260026 A1 Nov. 23, 2006

(51) Int. Cl.
*A42B 3/00* (2006.01)

(52) U.S. Cl. ..... 2/412; 2/411; 2/410; 2/414

(58) Field of Classification Search ..... 2/455, 1, 2/410–414

See application file for complete search history.

(56) References Cited

U.S. PATENT DOCUMENTS

| | | | | |
|---|---|---|---|---|
| 3,925,821 | A | 12/1975 | Lewicki | |
| 3,994,020 | A | 11/1976 | Villari | |
| 4,029,534 | A | 6/1977 | Bocks et al. | |
| 4,075,717 | A | 2/1978 | Lemelson | |
| 4,338,371 | A | 7/1982 | Dawn et al. | |
| 4,343,047 | A * | 8/1982 | Lazowski et al. | 2/411 |
| 4,558,470 | A | 12/1985 | Mitchell et al. | |
| 4,695,496 | A | 9/1987 | Lee | |
| 4,905,320 | A * | 3/1990 | Squyers, Jr. | 2/22 |
| 5,014,365 | A * | 5/1991 | Schulz | 2/412 |
| 5,025,504 | A | 6/1991 | Benston et al. | |
| 5,027,803 | A | 7/1991 | Scholz et al. | |
| 5,083,361 | A | 1/1992 | Rudy | |
| 5,134,725 | A * | 8/1992 | Yeshurun et al. | 2/2.5 |
| 5,274,846 | A | 1/1994 | Kolsky | |
| 5,423,087 | A | 6/1995 | Krent et al. | |
| 5,603,117 | A | 2/1997 | Hudner, Jr. et al. | |
| 5,741,568 | A | 4/1998 | Rudy | |
| 5,755,110 | A * | 5/1998 | Silvas | 62/259.3 |
| 5,778,470 | A * | 7/1998 | Haider | 5/645 |
| 5,896,758 | A | 4/1999 | Rock et al. | |
| 5,913,412 | A | 6/1999 | Huber et al. | |
| 5,946,734 | A | 9/1999 | Vogan | |
| 5,952,078 | A * | 9/1999 | Park | 428/105 |
| 6,032,300 | A | 3/2000 | Bainbridge et al. | |
| 6,055,676 | A | 5/2000 | Bainbridge et al. | |
| 6,070,271 | A | 6/2000 | Williams | |
| 6,098,209 | A | 8/2000 | Bainbridge et al. | |
| 6,103,641 | A | 8/2000 | Gehring, Jr. | |
| 6,108,825 | A | 8/2000 | Bell et al. | |
| 6,301,722 | B1 * | 10/2001 | Nickerson et al. | 2/455 |
| 6,453,477 | B1 * | 9/2002 | Bainbridge et al. | 2/455 |
| 6,467,099 | B2 | 10/2002 | Dennis et al. | |
| 6,627,562 | B1 | 9/2003 | Gehring, Jr. | |
| 7,257,846 | B2 * | 8/2007 | Paciorkowski | 2/267 |
| 2002/0002730 | A1 | 1/2002 | Dennis et al. | |
| 2002/0152542 | A1 | 10/2002 | Dennis et al. | |
| 2005/0193470 | A1 * | 9/2005 | Nalls | 2/181 |

* cited by examiner

*Primary Examiner* — Shaun R Hurley
*Assistant Examiner* — Andrew W Sutton
(74) *Attorney, Agent, or Firm* — Henry E. Bartony, Jr.; James G. Uber

(57) ABSTRACT

The present invention provides pads and padding systems for use in protective helmets, and particularly ballistic helmets. Generally, the pad includes a first, outer layer which provides substantial impact resistance and a second, inner layer which provides cushioning and comfort. The pad does not require the use of a moisture-proof, non-perforated, encapsulating layer since both layers provide little resistance to fluid flow. The pad may also include a cover made of moisture-wicking material.

29 Claims, 3 Drawing Sheets

Fig. 1A
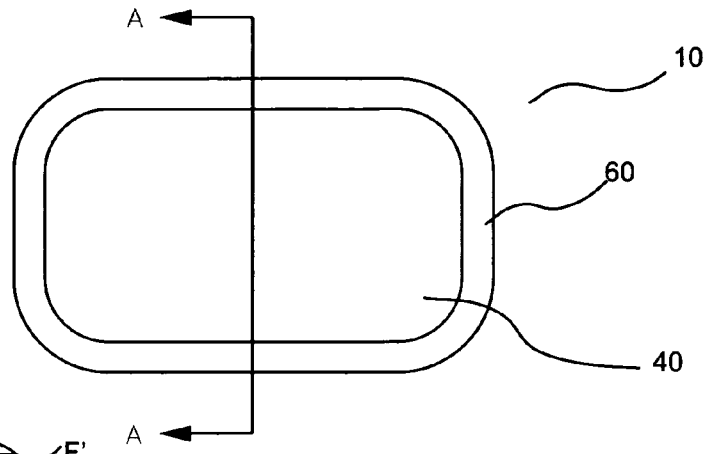
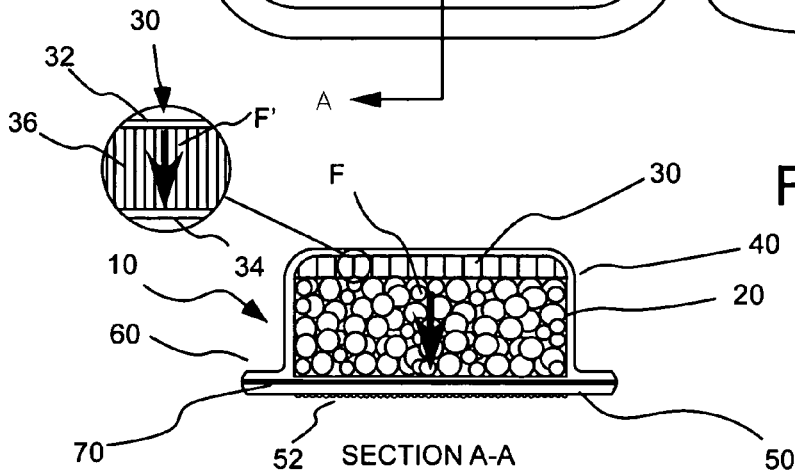
Fig. 1B
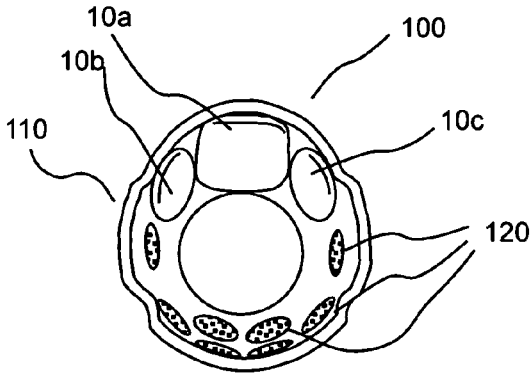
Fig. 2A
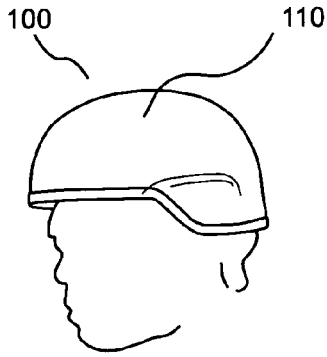
Fig. 2B

PROTECTIVE PADDING AND PROTECTIVE PADDING SYSTEMS

BACKGROUND OF THE INVENTION

The present invention relates generally to protective padding or cushions and to protective padding or cushioning systems, and, particularly, to protective padding and padding systems for use in protective helmets.

Although several embodiments of the present invention are discussed in connection with the use thereof as protective pads and/or padding systems in protective helmets, one skilled in the art appreciates that the protective padding and protective padding systems of the present invention have wide applicability for uses other than in connection with protective helmets.

In a number of protective helmets, a webbing system has been used to suspend a helmet shell on the wearer's head. In the case of military helmets, the space between the webbing and the helmet shell (fabricated, for example, from KEVLAR® materials available from DuPont) contributes to the impact performance of the helmet. Additionally, such airspace also facilitates cooling within the helmet.

Webbing suspension systems, however, can result in undesirable pressure points, leading to discomfort. Recently, webbing suspension systems in certain helmets, including certain military helmets, have been replaced by padding systems. For example, in the MICH or ACH combat helmets available from Mine Safety Appliances Company of Pittsburgh, Pa., a plurality of comfort pads of different shapes and sizes can be positioned within the helmet in a configuration determined by the user in accordance with the manufacturer's recommendation. A hook-and-loop type fastening system is, for example, used to removably attach the pads to the interior of the helmet shell. The removable pads provide for a customized fit, improving weight distribution and promoting comfort and balance. The pads also dissipate energy for protection of the user from head trauma. Moreover, the pads provide an airspace between the helmet shell and the user to promote cooling.

Such a padding or cushioning system is disclosed in U.S. Pat. No. 6,467,099. That padding or cushioning structure includes a plurality of pads, each having a body-facing side, a spaced load-facing side, and a layered assembly intermediate between the two sides. The layered assembly includes (a) an acceleration-rate-sensitive, cushioning core structure and (b) a fully-jacketing, moisture-proof, non-perforated but gas-permeable barrier layer completely encapsulating the core structure to block completely any flow of moisture from the outside of the pad into the core structure. When under the influence of an elevated, localized, non-atmospheric pressure applied to and on the pad's body-facing side, the acceleration-rate sensitive, cushioning core flows in a manner which tends to dissipate or distribute such pressure. The layered assembly can also include (for example, at least on the body-facing side of the pad, and on the outside of said barrier layer) a moisture-wicking layer operable to wick away moisture presented to the pad on its body-facing side.

In general, pads or cushions for use in protective helmets are preferably lightweight so as to reduce the overall weight of the helmet. The pads should also provide comfort and impact resistance over a wide range of environmental conditions (including, for example, wide ranges of temperature, atmospheric pressure, and moisture). Moreover, such pads should also provide for adequate air movement and heat transfer. Currently available padding systems meet such conditions with varying degrees of success.

It thus remains desirable to develop improved protective padding and protective padding systems.

SUMMARY OF THE INVENTION

Generally, the present invention provides a protective padding or cushioning system for use in cushioning contact with a body (for example, in a protective helmet comprising a plurality of pads of the present invention). Each pad comprises at least one section of an outer layer of a flexible, resilient, energy absorbing material that is adapted to pass fluids therethrough, and at least one section of an inner layer, adjacent the section of the outer layer, and positioned inside the section of the outer layer when worn on the body. The inner layer is of a flexible, resilient material that is less stiff than the outer layer. The inner layer is also adapted to pass fluids therethrough. The pad permits fluids to pass therethrough in a direction generally perpendicular to the body, and after saturation of the pad by immersion in water, subsequent removal of bulk water from the pad by shaking the pad by hand for one minute in various orientations, and drying of the pad for one hour at 77° F. and 50% relative humidity, the pad has a weight gain that is less than 30%. Preferably, the weight gain of the pad is less than 20%. More preferably, the weight gain of the pad is less than 10%.

In one embodiment, the outer layer comprises a plurality of discrete beads of substantially elastic, resilient material, positioned adjacent one another and having interstitial spaces therebetween through which air and water can pass. Preferably the beads are waterproof. In one embodiment, the inner layer comprises a first layer and a second layer spaced from the first layer and a plurality of yarns connecting with the two layers. The inner layer can, for example, be formed from one or more hydrophilic materials.

The pad of the present invention can further include a cover comprising an inner cover material placed adjacent to and over an inner surface of the inner layer and an outer cover material connected to the inner cover material to encompass the inner layer and the outer layer. The inner cover can, for example, comprise a hydrophilic, wicking material that can be treated for increased comfort. The outer cover material can be permanently connected to the inner cover material along the perimeter of the pad.

The pad may also include a fastening mechanism to fasten the pad to an article worn on the body, such as a helmet. In one embodiment, the fastening mechanism comprises hooks or loops for use in a hook-and-loop type connection.

The present invention also provides a protective helmet including a shell and a plurality of pads as described above within the shell adapted to be placed in cushioning contact with the head of the user.

In a further aspect, the present invention provides a protective helmet including a shell and an impact cap therein for use in cushioning a body. The impact cap includes a layer of a flexible, resilient, energy absorbing first material that can pass fluids therethrough. The first material can include a plurality of discrete beads of substantially elastic, resilient material positioned adjacent one another and having interstitial spaces therebetween through which fluids can pass. The impact cap can also include at least one section adjacent the first material comprising a flexible, resilient second material that is adapted to pass fluids therethrough and being less stiff than the layer of first material.

As illustrated by the above-described helmet including an impact cap, cushioning pads or systems of the present invention can be formed in many alternative configurations. Impact caps (for use, for example, in a firefighter's or other protective helmet) and other cushioning systems, can be made from the material used as the outer layer of the pads of the present invention as described above. In the impact caps and other cushioning pads or systems (for example, cushioning pads or systems specifically shaped or formed to cover parts of the body other than the head) of the present invention, individual comfort sections made, for example, from the material used as the inner layer of the pads of the present invention as described above can be placed on the inside of the impact cap or other cushioning pad or system. These comfort sections can be permanently attached to the impact cap or other cushioning system with adhesive or removably attached with the hook-and-loop type fasteners. As used herein, the term "pad" refers generally to both flat and formed or shaped cushioning devices or systems.

In still a further aspect, the present invention provides a pad for use in cushioning contact with a body including at least one section of an outer layer of a flexible, resilient, energy absorbing material. The outer layer includes a plurality of discrete beads of substantially elastic, resilient material positioned adjacent one another and having interstitial spaces therebetween through which fluids can pass. The pad further includes at least one section of an inner layer adjacent the section of the outer layer and positioned inside the section of the outer layer when worn on the body. The inner layer is of a flexible, resilient material and is less stiff than the outer layer. The inner layer is also adapted to pass fluids therethrough. The inner layer can, for example, include a first layer, a second layer spaced from the first layer and a plurality of yarns connecting the two layers.

BRIEF DESCRIPTION OF THE DRAWINGS

Other aspects of the invention and advantages thereof will be discerned from the following detailed description when read in connection with the accompanying drawings, in which:

FIG. 1A illustrates a top plan view of one embodiment of a pad of the present invention.

FIG. 1B illustrates a cross-section view of the pad of FIG. 1A.

FIG. 2A illustrates an underside view of an embodiment of a protective helmet of the present invention (without chin strapping) including several pads of the present invention.

FIG. 2B illustrates a prospective view of the helmet of FIG. 2A as worn by a user (without chin strapping).

DETAILED DESCRIPTION OF THE INVENTION

Figure 3A:
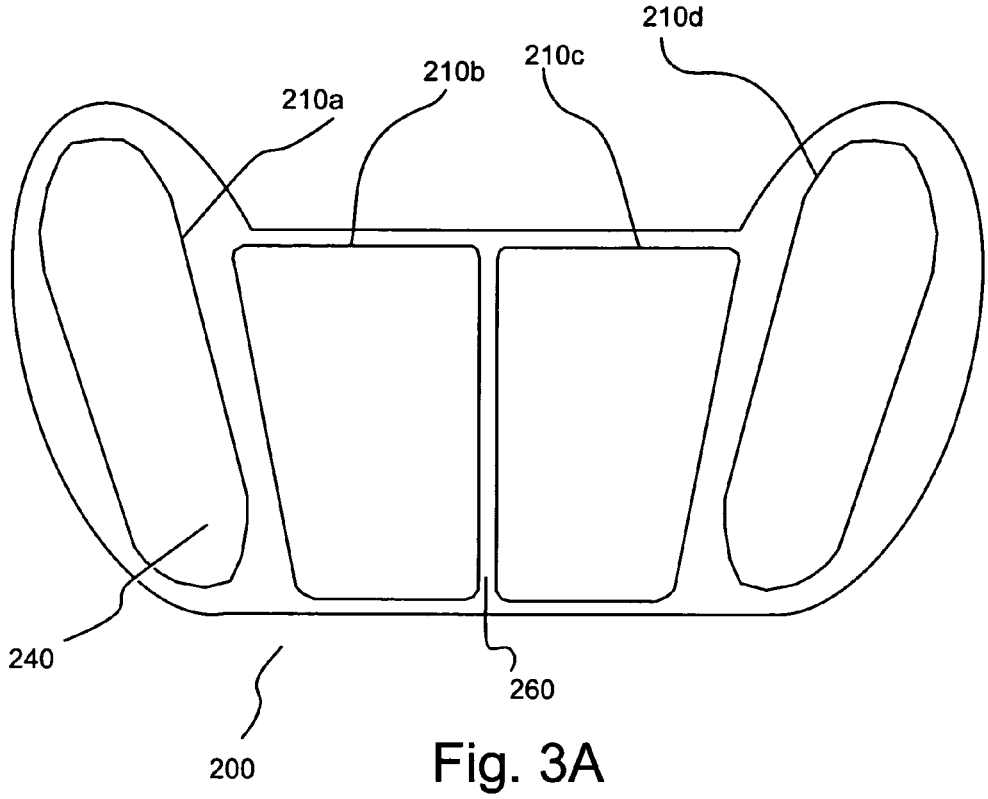
FIG. 3A illustrates a top plan view of a multi-pad padding system of the present invention.

FIGS. 1A and 1B illustrate an embodiment of a pad or cushion 10 of the present invention for use, for example, as a body pad or cushion. Pad 10 is particularly suited for use in ballistic-resistant helmet systems although it can be used in any protective helmet. In the embodiment of FIGS. 1A and 1B, pad 10 includes a first, outer or helmet-side layer of material 20 (see FIG. 1B) which provides substantial impact resistance. Preferably, the outer layer material 20 is lightweight and consistently absorbs impact energy (that is, provides "impact resistance") even when cycled over multiple impacts. Also, the impact resistance of the material of outer layer 20 preferably remains in a desirable range over a wide range of ambient or environmental conditions. For example, in one embodiment, the impact resistance is acceptable over a temperature range of approximately 15° F. to 130° F. Similarly, neither rapid changes in atmospheric pressure (i.e., air transport) nor the presence of water (either in the form of high humidity or the presence or liquid water) substantially affects the impact resistance and/or the breathability of the material of outer layer 20.

As used herein, the designation "inner" refers generally to a component, surface or direction toward the body when an article is worn, and the designation "outer" refers generally to a component, surface or direction away from the body when an article is worn.

In one embodiment, the material of outer layer 20 includes fluid flow pathways that provide little resistance to fluid flow (gas and/or liquid) or has a porosity such that the material does not retain water therein. This low resistance to fluid flow also facilitates air movement or breathability. Preferably, the material of outer layer 20 allows fluid flow such that when a 3"×3"×⅝" sample of the material is saturated with water by being submerged in 3 feet of water for 12 hours, shaken by hand in various orientations for one minute to remove bulk water, and allowed to dry for one hour in a standard ambient environment of 77° F. and 50% relative humidity on a screen rack or other device, the water retained in the sample results in a weight gain of less than 30%, preferably less than 20%, more preferably less than 15% and even more preferably less than 10%. In the studies of the present invention, the materials were placed on a screen rack or other similar device, such that water flowed via gravity generally in a direction perpendicular to orientation of the body when pad 10 is in use—see arrow F in FIG. 1B and arrow F' in the expanded portion of FIG. 1B.

The material of outer layer 20 is also preferably lightweight. In that regard, the density of the material of outer layer 20 is preferably less than 6 $lb/ft^3$, more preferably less than 4 $lb/ft^3$, and even more preferably less than 3 $lb/ft^3$.

The material of outer layer 20 can, for example, be formed from a plurality of resilient beads that are assembled into a pad section or layer (for example, by use of an adhesive material). Such a material is commercially available from Brock USA of Boulder, Colo. and is described generally in U.S. Pat. No. 6,301,722, the disclosure of which is incorporated herein by reference. In general, such materials are porous, closed-cell composites, formed by adhering together resilient, waterproof, closed cell polymer beads (typically, only at their tangent points). The resultant material is a durable, non-absorptive composite. The material allows fluids such as air and water to flow freely through interstitial spaces in the material in all directions. Examples of the closed-cell polymeric materials incorporated into such materials include polypropylene or polyethylene foam, blends of polypropylene and polyethylene foams, and rubberized polypropylene and/or polyethylene foams. Impact resistant materials formed from a plurality of resilient polymeric beads are described generally in U.S. Pat. Nos. 6,301,722, 6,032,300, 6,098,209, 6,055,676 and 5,920,915, the disclosures of which are incorporated herein by reference.

Such materials are considered time-rate dependent, energy dissipating materials that absorb energy in several ways. Under low impact energy, the individual beads propagate to fill interstitial air voids in the material, thereby dissipating energy through interstitial friction. Under higher energy impacts, the beads themselves can further deform, effecting mechanical energy dissipation. Under even higher energy impacts, the adhesive bonds joining the beads can fracture, thereby dissipating further energy. In the saturation/drying test described above, such materials exhibited a weight gain of approximately 8% or less. The density of such materials (when dry) was approximately 2.1 lb/ft$^3$.

Pad 10 further includes a second, inner or body-side layer 30 which provides cushioning and comfort. Although, outer layer 20 as described above provides very good impact resistance over a wide range of conditions, such materials can be somewhat uncomfortable when placed against the body. Like outer layer 20, inner layer 30 preferably provides for passage of fluids such as water and air therethrough. However, inner layer 30 can be less rigid or stiff than outer layer 20, thereby providing increased comfort to a user.

Preferably, the material of inner layer 30 has sufficiently low resistance to fluid flow therethrough such that when a 3"×3"×¼" sample of the material is saturated with water by being submerged in 3 feet of water for 12 hours, shaken by hand in various orientations for one minute to remove bulk water and allowed to dry for one hour in a standard ambient environment of 77° F. and 50% relative humidity on a screen rack or other device, the water retained in the sample results in a weight gain of less than 30%. Indeed, materials having the preferred physical characteristics of the material for inner layer 30 can exhibit weight gains of less than 10%, less than 3% and even less than 1%.

Like the material for outer layer 20, the material of inner layer 30 is also preferably lightweight. In that regard, the density of the material of inner layer 30 is preferably less than 6 lb/ft$^3$, more preferably less than 4 lb/ft$^3$, and even more preferably less than 3 lb/ft$^3$. Indeed, given the desired physical characteristics of the material for inner layer 30, materials having a density of less than 1 lb/ft$^3$ can be used.

Inner layer 30 in a number of embodiments of the present invention is a resilient, collapsible material that defines spaces therethrough to provided low resistance to fluid flow. In several embodiments of the present invention the material of inner layer 30 was a three-dimensional knit spacer fabric as described, for example, in U.S. Pat. Nos. 6,627,562 and 6,103,641, the disclosures of which are incorporated herein by reference. Such materials are commercially available from Gehring Textiles, Inc. of New York, N.Y. In general, such materials include a first fabric layer 32 made from high performance, high tenacity yarns and a second fabric layer 34 of an open mesh construction to facilitate air circulation. The material also includes a plurality of high performance yarns 36 (typically, monofilament yarns) connecting the two layers. The connecting, high performance yarns 36 provide a buckling column effect to provide resilient compressibility. The materials of inner layer 30 can be hydrophilic to enhance transport of body fluids away from the body, keeping the skin dry (for example, by capillary action). In general, inner layer 30 provides some impact resistance or energy absorbance or dissipation function, but typically less than that provided by outer layer 20. One or more of the materials of inner layer 30 can be treated chemically to enhance performance including its water wicking ability. The materials can be woven in the warp, weft and Z dimension.

In the saturation/drying test described above, such materials exhibited a weight gain of less than 1%. Preferably, inner layer 30 is less dense and thus adds less weight per unit thickness to pad 10 than does outer layer 20. The three-dimensional knit spacer fabrics described above are typically very light in weight with densities less than 1 lb/ft$^3$ and do not add appreciable weight to pad 10. Combining the results of the saturations/drying studies of the materials of outer layer 20 and inner layer 30, pads 10 exhibited a weight gain of less than 8% in such studies.

The pads of the present invention, including outer layer 20 and inner layer 30, without any cover layer thereon (which can be an absorbent wicking material as described below), preferably exhibit a weight gain of less than 30% after saturation of the pad by immersion in water, subsequent removal of bulk water from the pad by shaking the pad for one minute, and drying of the pad for one hour at 77° F. and 50% relative humidity. Preferably, the weight gain of the pad is less than 20%. More preferably, the weight gain of the pad is less than 10%. Each of outer pad layer 20 and inner pad layer 30 can be tested individually as described above and the results combined to provide a measurement for the assembled pad. Alternatively, inner layer 20 and outer layer 30 can be tested together. In several embodiments of the present invention, outer layer 20 and inner layer 30 were adjacent, but not connected, in assembled pad 10. Individual testing of inner layer 20 and outer layer 30 was thus performed. Outer layer 20 and inner layer 30 can be connected (for example, via an adhesive) in assembled pad 10, but care should be taken to not interfere with fluid flow through the pad in a significant manner. Outer layer 20 can, for example, be adhered to inner layer 30 using relatively small spots of adhesive that are spaced from each other to prevent significant interference with fluid flow through pad 10.

Pad 10 can further include an inner cover layer 40, which comes into contact with the body of the user. The material for cover layer 40 is preferably a hydrophilic, wicking material that absorbs moisture resulting, for example, from perspiration and transfers it away from the body (for example, from the head when used in a helmet) through, for example, capillary action. In one embodiment, cover layer 40 was fabricated from nylon, polyester, and/or other hydrophilic material which was conditioned by brushing or napping one side to thereby comfortably contact the user's body. Other embodiments can, for example, include other fabric conditioning to enhance wicking or comfort characteristics such as resistance to heat, flame, bacteria or fungus. Hydrophilic cover layer 40 wicks perspiration toward and even into adjoining inner layer 30 or outer layer 20. Airflow through outer layer 20 and inner layer 30 causes evaporation of moisture held within the capillaries of cover layer 40 or passed into inner layer 30 or outer layer 20 and thereby promotes cooling.

Preferably pad 10 also includes an outer, cover layer 50 which can, for example, be connected or sealed to inner cover layer 40 about a perimeter 60 of pad 10, thereby fully encompassing or enclosing outer layer 20 and inner layer 30 within a cover formed by inner cover layer 40 and outer cover layer 50. In the embodiment of FIGS. 1A and 1B, pad 10 includes a relatively thin layer of polyurethane film 70 (for example 5 mil.) used to seal inner cover layer 40 to outer cover layer 50 by, for example, heat sealing or ultrasonic welding. However, inner cover layer 40 and outer cover layer 50 can be connected in many alternative manners as long as the connection is suitable to withstand common usage of pad 10. For example, inner cover layer 40 and outer cover layer 50 can be connected by sewing.

In the embodiment of FIGS. 1A and 1B, the outer surface of outer cover layer 50 includes a connector material such as a loop material 52 as commonly used in hook-and-loop type fasteners. Preferably, all the materials used in the various layers of pad 10 provide relatively low resistance to fluid flow as described above. By providing for the relatively free flow of fluids (gas and/or liquid) through the pad of the present invention, enclosing, moisture-proof barrier layers used in connection with some known padding systems are unnecessary and undesirable for use in the present invention.

FIGS. 2A and 2B illustrate an embodiment of a military helmet 100 including a shell 110 of ballistic-resistant material such as KEVLAR. Pads 10*a* 10*b* and 10*c* (constructed generally as described above for pad 10) are illustrated in FIG. 2A connected to the interior of helmet shell 110. In that regard, helmet shell 110 includes hook-type fastening areas 120 at various positions thereon to which the loop materials 52*a*, 52*b* and 52*c* (not shown in FIG. 2A, but essentially the same as loop material 52 of pad 10) on the outer cover surfaces of pads 10*a*, 10*b* and 10*c*, respectively, are removably connectible. Pads of various sizes and shapes can be connected to helmet shell 110 in a manner controlled by the user to improve the comfort and fit of helmet 100, but within the guidelines specified by the helmet manufacturer. While FIGS. 2A and 2B show a military helmet 100, various other protective helmets including fire helmets and hard hats can be used in the present invention.

In several embodiments of the present invention, the total pad thickness (approximately, the thickness of outer layer 20 added to the thickness of inner layer 30) was in the range of approximately 0.75 to 1.0 inches. The thickness of inner cover layer 30 was approximately 0.25 inches. Preferably, inner layer 30 contacted outer layer 20 without an intervening layer of material and without any adhesive or other bonding connection therebetween. In this embodiment, the pad, when assembled as a system of components, was designed to compress no more than 0.25 inches in any area (that is, the thickness of inner layer 30). It was found that this thickness of inner layer 30 was sufficient to account for differences in head shape and to provide stability. If a pad becomes uncomfortable as a result of complete compression of inner layer 30 and, thereby, contact with outer layer 20 for a particular user, the overall thickness of the pad may be incorrect for that user and can be adjusted accordingly.

In general, a 25% compression test on the pad system can be used to determine if a material is suitable for use as inner layer 30. For such a compression test, a force gage is used to compress a 0.50" diameter round attachment the required distance (that is, 25% or ¼ of the thickness of the tested material). The force required in pounds is then divided by the area of the 0.5" diameter round attachment to calculate a pressure in units of pounds per square inch or psi. In the studies of the present invention, samples of inner layer 30 that were 0.25 inches thick were tested in combination with samples of outer lay 20 at room temperature (approximately 25° C.). Preferably, the pressure determined in the 25% compression test is not greater than 1.2 psi. More preferably, the pressure is in the range of approximately 0.6 to 1.0 psi. In this range, the material will provide comfort while maintaining stability. Preferably, the 25% compression pressure remains within a suitable range over a wide variation in environmental conditions (for example, temperature, pressure and moisture conditions as described above).

Figure 3B:
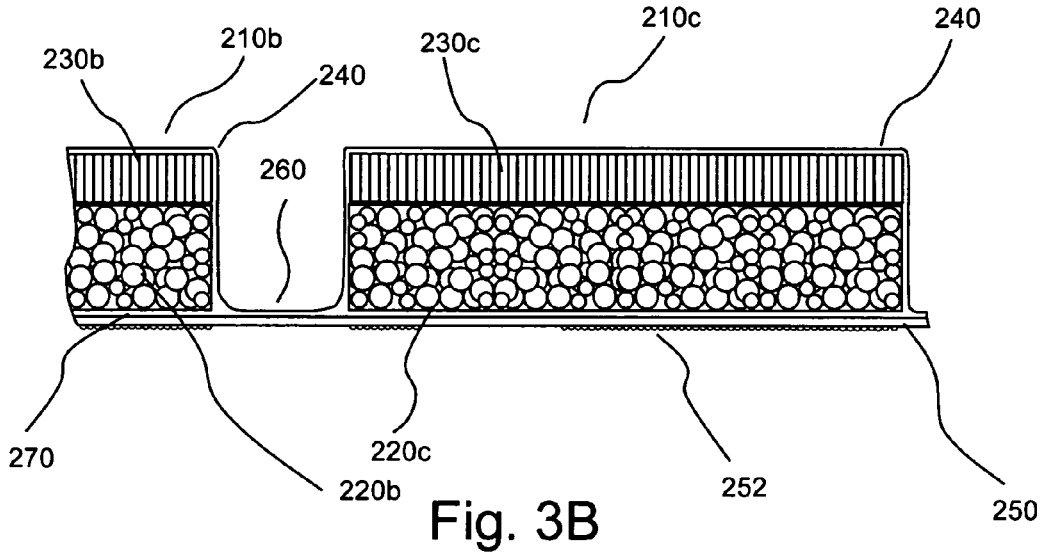
FIG. 3B illustrates a cross-sectional view of a portion of the padding system of FIG. 3A.

As illustrated in FIGS. 2A and 2B, a plurality of pads of the present invention can be formed in generally any configuration within common cover layers. In the embodiment of FIGS. 3A and 3B, four pad sections 210*a*, 210*b*, 210*c* and 210*d* are enclosed within a common inner cover layer 240 and a common outer cover layer 250 to form a padding system 200. In general, the layers of padding system 200 are the same in composition as the layers of pad 10 and like components are numbered similarly to corresponding components of pad 10 with the addition of 200 thereto. For example, FIG. 3A illustrates a cross-sectional view of a central portion of padding system 200 encompassing generally trapezoidal shaped padding sections 210*b* and 210*c*. Padding section 210*c* includes an outer layer 220*c* and an inner layer 230*c* corresponding to outer layer 20 and inner layer 30 of pad 10. Inner cover layer 240 extends over the entirety of pad system 200 and is connected to outer cover layer 250 using heat sealing or sonic welding of an intermediate polyurethane layer 270 in regions 260 around and between padding sections 210*a*, 210*b*, 210*c* and 210*d*. A loop surface 252 is provided on the outer surface of outer cover layer 250 for connection to a hook fastener as described above.

The material of outer layer 20 as described above is readily formable (for example, molded or thermomolded) into a wide variety of shapes. The other layers of the pads of the present invention are readily conformable to any such shape. In one embodiment of the present invention, such layers can be formed into an impact cap 310 (see FIGS. 4A and 4B) as described, for example, in U.S. Pat. Nos. 4,286,339, 5,044,016 and 6,032,297, the disclosures of which are incorporated herein by reference.

Figure 4A:
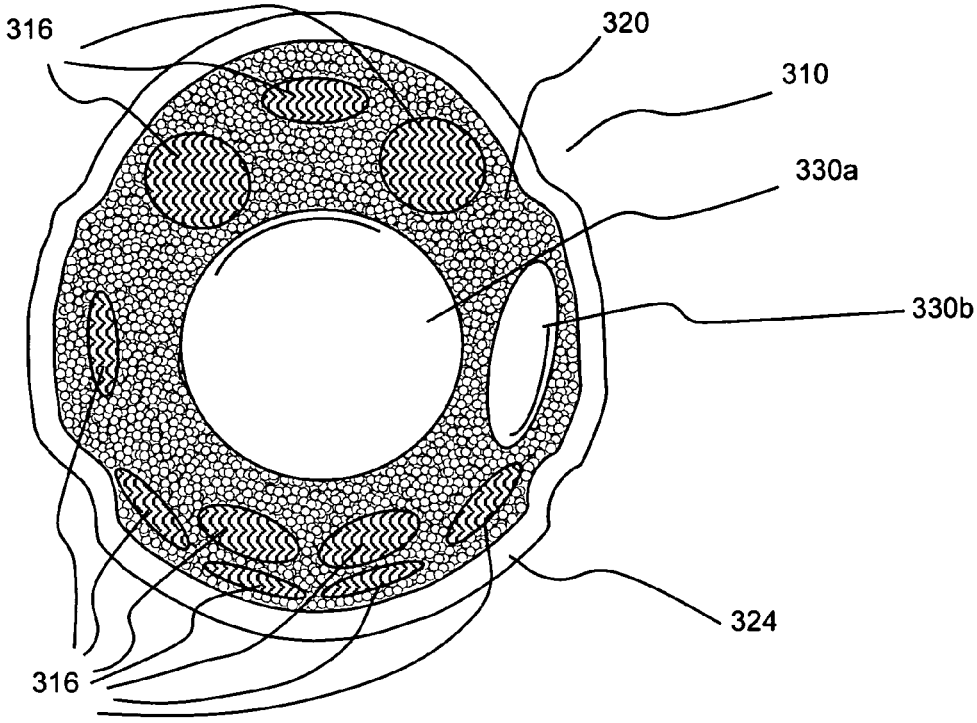
FIG. 4A illustrates an embodiment of a bottom view of an impact cap of the present invention.
Figure 4B:
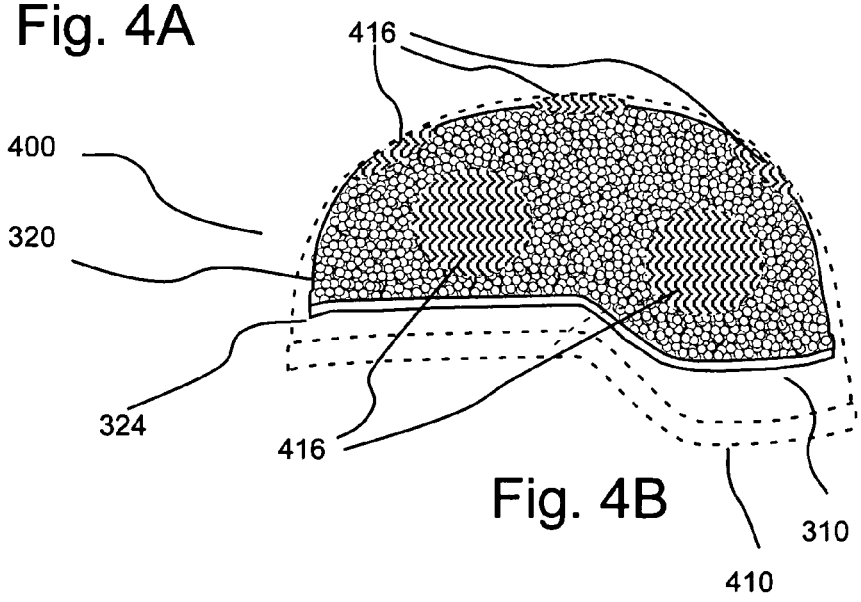
FIG. 4B illustrates a side view of the impact cap of FIG. 4A positioned within a protective helmet (shown in dashed lines).

Impact cap 310 of FIGS. 4A and 4B is formed to have an outer section or layer 320 which has the physical characteristics of outer layer 20 of pad 10 described above. In one embodiment, outer section 320 is formed from a material comprising a plurality of resilient beads (as described above for outer layer 20 of pad 10) that are formed to the shape of impact cap 310. As described above, such materials are commercially available from Brock USA of Boulder, Colo. and are described, for example, in U.S. Pat. No. 6,301,722. A border or protective perimeter 324 (for example, formed from a polymeric material) can be placed or formed around the bottom perimeter of impact cap 310 to prevent damage or fraying.

An inner layer or individual comfort pads or sections made, for example, from a material suitable for use as inner layer 30 of pad 10 is preferably provided between the head of the user and outer layer or section 320. In the embodiment illustrated in FIG. 4A, individual sections of such a material (two pads or sections 330*a* and 330*b* are illustrated) are removably attached to outer section 320 using fasteners 316 such as hook-and-loop type fasteners. As is clear to one skilled in the art, other types of fastening systems can be used for removable or nonremovable connection of inner sections 330*a*, 330*b* etc. to outer section 320. Moreover, in an alternative embodiment, an inner section can be formed to be generally coextensive with the inner wall of outer layer 320.

FIG. 4B illustrates a helmet 400 including impact cap 310 placed within helmet shell 410. In the embodiment of FIG. 4B, impact cap 310 is removably held within helmet shell via a plurality of hook-and-loop type fastening systems 416. As is clear to one skilled in the art, many types of fastening systems can be used to removably or nonremovably attach impact cap 310 within helmet shell 410.

In general, the pads and padding systems of the present invention are easily fabricated at relatively low cost. Moreover, the pads of the present invention provide increased heat dissipation, increased perspiration evaporation, lower water retention and less sensitivity to environmental conditions than currently available pads used in connection with protective helmets and particularly ballistic-resistant helmets. The materials of the pads of the present invention provide multi-impact resistance (for example, as determined during cyclic durability type compression) at very low weight. Moreover, the pads of the present invention are readily fabricated from materials that are inert and resistant to repeated washings and exposure to a wide range of field conditions.

Although the present invention has been described in detail in connection with the above embodiments and/or examples, it should be understood that such detail is illustrative and not restrictive, and that those skilled in the art can make variations without departing from the invention. The scope of the invention is indicated by the following claims rather than by the foregoing description. All changes and variations that come within the meaning and range of equivalency of the claims are to be embraced within their scope.

What is claimed is:

1. A pad for use in cushioning contact with a body comprising:

at least one section of an outer layer of a flexible, resilient, energy absorbing material, the outer layer being adapted to pass fluids transversely through the outer layer with low resistance; and at least one section of an inner layer adjacent the section of the outer layer and positioned inside the section of the outer layer when worn on the body, the inner layer being of a flexible, resilient material and being less stiff than the outer layer, the inner layer being adapted to pass fluids therethrough with low resistance, the outer layer comprising a plurality of discrete beads of elastic, resilient material positioned adjacent one another and bonded together, wherein the beads elastically deform to absorb energy over multiple impacts to provide impact resistance, the beads having interstitial spaces therebetween through which fluids can pass so that fluids pass transversely through the outer layer with low resistance, the outer layer having a density no greater than 4 lb/ft$^3$, the inner layer comprising a first layer, a second layer spaced from the first layer and a plurality of yarns connecting the two layers, the plurality of yarns provide a buckling effect to provide resilient compressibility.

2. The pad system of claim 1 wherein the beads are bonded together via an adhesive and are waterproof.

3. The pad system of claim 1 wherein the beads are close celled polymer beads.

4. The pad of claim 1 wherein air and water can pass through the interstitial spaces.

5. The pad of claim 1 wherein the yarns connecting the first layer and the second layer are monofilament.

6. The pad of claim 4 wherein the inner layer has an open mesh construction.

7. The pad of claim 5 wherein the beads of the outer layer are waterproof.

8. The pad of claim 7 wherein the inner layer is formed from one or more hydrophilic materials.

9. The pad of claim 5 wherein the inner layer and the outer layer are encompassed by a cover.

10. The pad of claim 9 wherein the cover comprises an inner cover material placed adjacent to and over an inner surface of the inner layer, the inner cover comprising a hydrophilic, wicking material.

11. The pad of claim 10 wherein an outer surface of the outer cover material includes a fastening mechanism to fasten the pad to an article worn on the body.

12. The pad of claim 11 wherein the fastening mechanism comprises hooks or loops for use in a book-and-loop type connection.

13. A pad for use in cushioning contact with a body comprising:

at least one section of an outer layer of a flexible, resilient, energy absorbing material, the outer layer comprising a plurality of discrete beads of elastic, resilient material positioned adjacent one another and bonded together, wherein the beads elastically deform to absorb energy over multiple impacts to provide impact resistance, the beads having interstitial spaces therebetween through which fluids can pass so that fluids pass transversely through the outer layer with low resistance, the outer layer having a density no greater than 4 lb/ft$^3$; and at least one section of an inner layer adjacent the section of the outer layer and positioned inside the section of the outer layer when worn on the body, the inner layer being of a flexible, resilient material and being less stiff than the outer layer, the inner layer being adapted to pass fluids transversely therethrough with low resistance, the inner layer comprising a first layer, a second layer spaced from the first layer and a plurality of yarns connecting the two layers, the plurality of yarns provide a buckling effect to provide resilient compressibility.

14. The pad of claim 13 wherein the inner layer comprises a first layer, a second layer spaced from the first layer and a plurality of yarns connecting the two layers.

15. A protective helmet comprising a shell and a plurality of pads therein adapted to be placed in cushioning contact with a body, each pad being adapted to pass fluids therethrough in a direction generally perpendicular to the body and comprising:

an outer layer of a flexible, resilient, energy absorbing material adjacent to the shell, the outer layer comprising a plurality of discrete beads of elastic, resilient material positioned adjacent one another and bonded together, wherein the beads elastically deform to absorb energy over multiple impacts to provide impact resistance, the beads having interstitial spaces therebetween through which fluids can pass transversely through the outer layer, the outer layer having a density no greater than 4 lb/ft$^3$; and an inner layer adjacent the outer layer and positioned on the opposite side of the outer layer from the shell, the inner layer being of a flexible, resilient material and being less stiff than the outer layer, the inner layer being adapted to pass fluids therethrough with low resistance, the inner layer comprising a first layer, a second layer spaced from the first layer and a plurality of yarns connecting the two layers, the plurality of yarns provide a buckling effect to provide resilient compressibility.

16. The helmet of claim 15 wherein the inner layer comprises a first layer, a second layer spaced from the first layer and a plurality of yarns connecting the two layers.

17. The helmet of claim 16 wherein the inner layer is formed from one or more hydrophilic materials.

18. A protective helmet comprising a shell and an impact cap therein for use in cushioning a body, the impact cap comprising a layer of a flexible, resilient, energy absorbing first material that can pass fluids therethrough, the energy absorbing first material comprises a plurality of elastic, resilient material positioned adjacent one another and bonded together, wherein the beads elastically deform to absorb energy over multiple impacts to provide impact resistance, the beads having interstitial spaces therebetween through which air and water can pass transversely through the first material with low resistance, the outer layer having a density no greater than 4 lb/ft$^3$, and at least one section adjacent the first material comprising a flexible, resilient second material that is adapted to pass fluids therethrough with low resistance and is less stiff than the layer of first material, the second material comprising a first layer, a second layer spaced from the first layer and a plurality of yarns connecting the two layers, the plurality of yarns provide a buckling effect to provide resilient compressibility.

19. The protective helmet of claim 18 further comprising a plurality of sections of the second material adjacent the first material.

20. The protective helmet of claim 18 wherein the energy absorbing first material comprises a plurality of substantially elastic, resilient material positioned adjacent one another and having interstitial spaces therebetween through which air and water can pass.

21. The protective helmet of claim 17 wherein the inner layer has an open mesh construction.

22. The protective helmet of claim 17 wherein the yarns connecting the first layer and the second layer are monofilament yarns.

23. The protective helmet of claim 17 wherein the yarns connecting the first layer and the second layer are monofilament yarns.

24. The protective helmet of claim 23 wherein the beads are waterproof.

25. The protective helmet of claim 24 wherein the inner layer of each pad is formed from one or more hydrophilic materials.

26. The protective helmet of claim 23 wherein the inner layer of and the outer layer of each pad are encompassed by a cover.

27. The protective helmet of claim 26 wherein the cover of each pad comprises an inner cover material placed adjacent to and over an inner surface of then inner layer, the inner cover comprising a hydrophilic, wicking material.

28. The protective helmet of claim 27 wherein an outer surface of the outer cover material of each pad comprises a fastening mechanism to fasten the pad to the shell.

29. The protective helmet of claim 28 wherein the fastening mechanism of each pad comprises hooks or loops for use in a hook-and-loop type connection.

* * * * *